United States Patent [19]

Perutz

[11] Patent Number: 4,823,858

[45] Date of Patent: Apr. 25, 1989

[54] PORTABLE DISPLAY PANEL AND HINGE SYSTEM

[75] Inventor: Simon G. A. Perutz, Evanston, Ill.

[73] Assignee: Nimlok Company, Niles, Ill.

[21] Appl. No.: 57,382

[22] Filed: Jun. 2, 1987

[51] Int. Cl.[4] ..... A47G 5/00

[52] U.S. Cl. ..... 160/135; 16/366

[58] Field of Search ..... 160/135, 229 R, 351; 16/366, 368, 369

[56] References Cited

U.S. PATENT DOCUMENTS

| | | |
|---|---|---|
| 114,579 | 5/1871 | Marston . |
| D. 271,732 | 12/1983 | Ytter . |
| 1,375,212 | 4/1921 | Crone . |
| 2,970,396 | 2/1961 | Worrell . |
| 3,201,821 | 8/1965 | Ruckstuhl . |
| 3,913,656 | 10/1975 | Guyer . |
| 4,063,585 | 12/1977 | Stanley . |
| 4,147,198 | 4/1979 | Ytter . |
| 4,436,135 | 3/1984 | Ytter . |
| 4,491,166 | 1/1985 | Hanna . |
| 4,495,673 | 1/1985 | Khan . |
| 4,594,829 | 6/1986 | Herrgord . |
| 4,601,524 | 7/1986 | Ytter . |
| 4,610,560 | 9/1986 | Miller . |

FOREIGN PATENT DOCUMENTS

| | | |
|---|---|---|
| 0013999 | 1/1979 | European Pat. Off. . |
| 8517546 | 6/1985 | Fed. Rep. of Germany . |

*Primary Examiner*—Blair M. Johnson

*Attorney, Agent, or Firm*—Neuman, Williams, Anderson & Olson

[57] ABSTRACT

An improved display panel and hinge system is provided having a plurality of display panels arranged in side by side relation and hingedly interconnected whereby one of the panels is capable of being selectively rotated relative to the other panel through a maximum arc of substantially 360°. The panels, when in parallel face to face relation, form a compact unit suitable for storage or transport.

8 Claims, 3 Drawing Sheets

FIG. 1
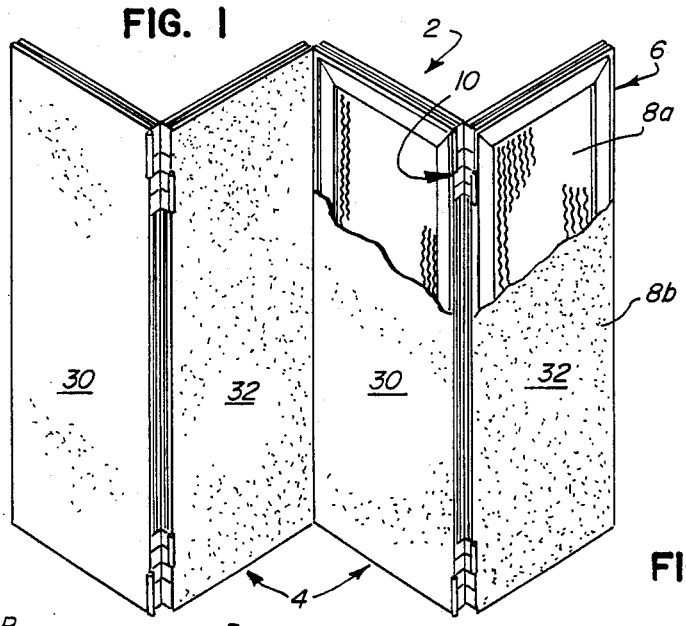
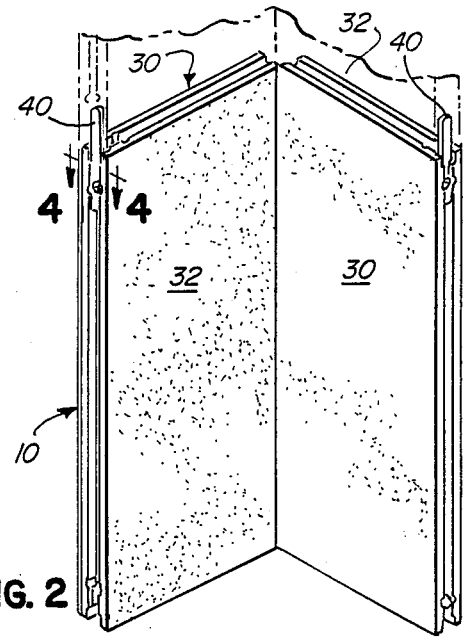
FIG. 2
FIG. 3
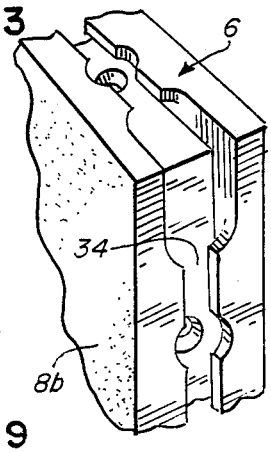
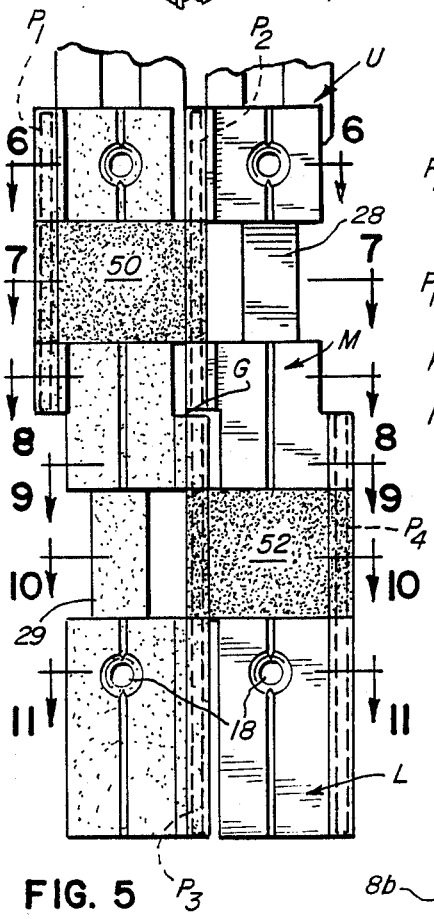
FIG. 5
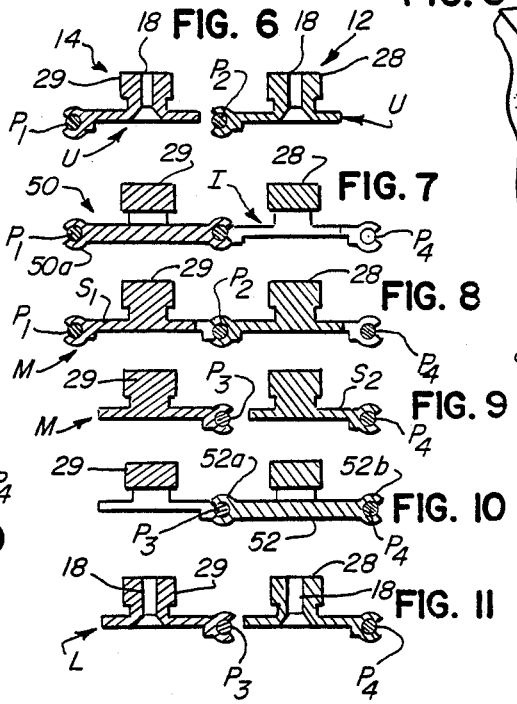
FIG. 6
FIG. 7
FIG. 8
FIG. 9
FIG. 10
FIG. 11
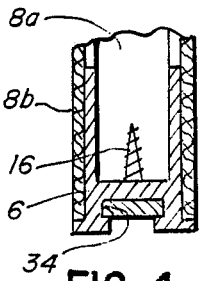
FIG. 4
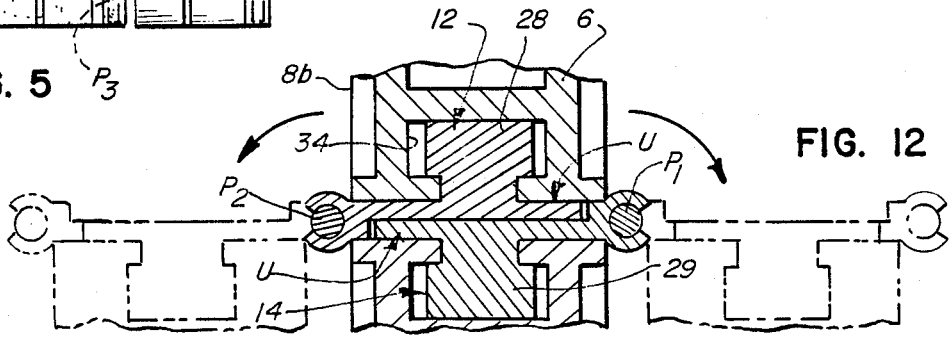
FIG. 12

FIG. 13
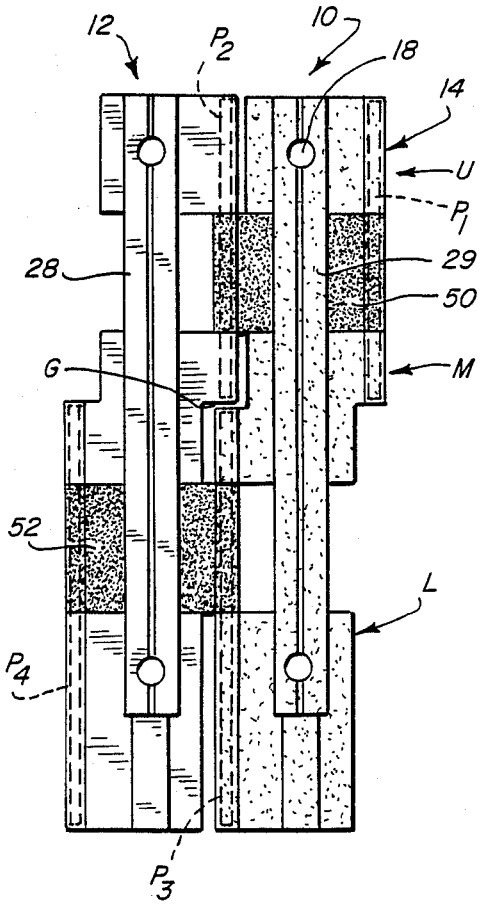
FIG. 14
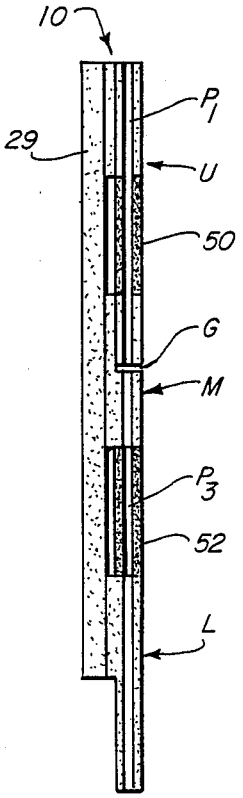
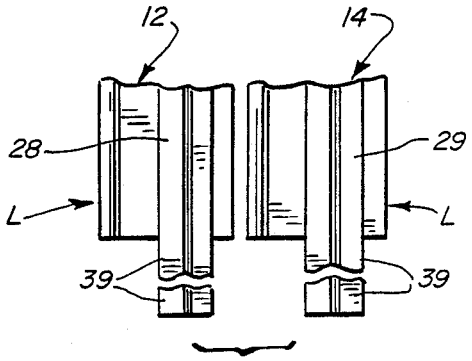
FIG. 13A

FIG. 15
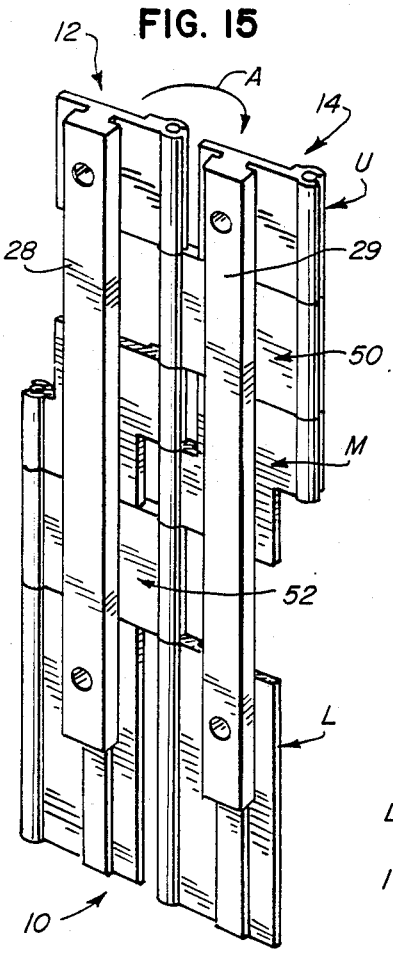
FIG. 16
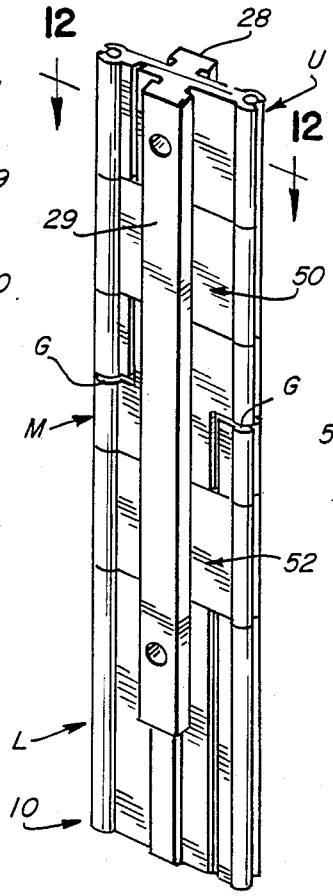
FIG. 17
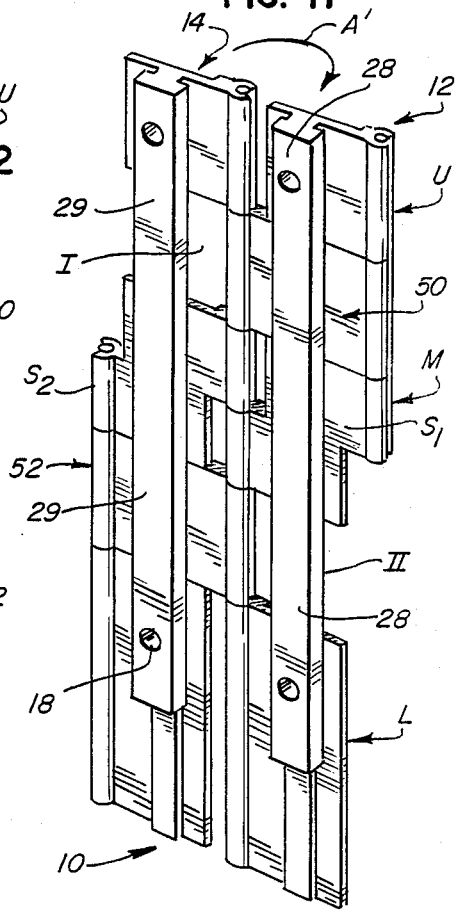
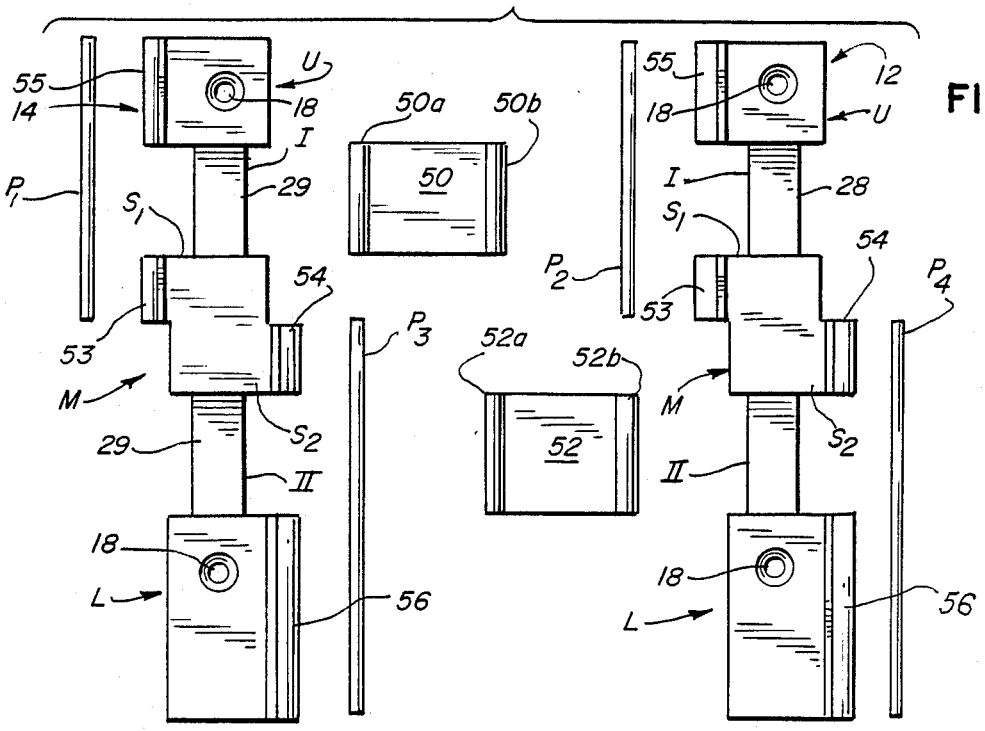
FIG. 18

PORTABLE DISPLAY PANEL AND HINGE SYSTEM

BACKGROUND OF THE INVENTION

1. Field of the Invention

The present invention relates to display panel systems utilized for exhibiting at trade shows, promotional events and the like. More particularly, the present invention relates to improved borderless panels and a hinge arrangement which allows 360° relative rotation of the display panels about a pair of vertical axes. The hinges of the present invention also allow vertical mounting or stacking of the display panels through complemental finger protrusions and corresponding slots.

2. Description of the Prior Art

A variety of display systems of this general type have heretofore been developed in which a number of display panels are supported by various types and arrangements of hinges, pin connectors and similar support means. Portable display systems typically comprise a plurality of hollow display panels, such as those shown in U.S. Pat. No. 4,147,198 to Ytter. Each display panel in the system is constructed from parallel wall boards which are secured in face to face relation within some type of border strip or frame. The border strip completely surrounds the perimeter of the wall boards. Adjacent panels are typically hinged together to allow various degrees of folding and unfolding about a vertical axis.

In certain prior art display systems, the hinge(s) thereof may be attached to the edges of the display panels by the utilization of slots along the outer surface of the border strip. Attachment is made by connecting the hinge to holding inserts which are inserted into the outer slot of the border strip. In display panel systems without hinges, panels thereof may be connected by insertion of a support piece into a slot in the border strip. These examples of prior art systems are beset with various shortcomings. Such shortcomings include complexities in the construction of the display system components, and difficulties in the assembly and disassembly of the system components. Additionally, the prior art systems are not easily expanded to include additional panels or easily reduced in size for use in a tabletop display.

The range of uses of display systems for exhibit purposes is very large; thus, the user has a need for versatility in the construction of the system. Additionally, the user requires that such system components be lightweight and easily disassembled for transport or storage. Marketing and sales groups which utilize such systems, for example, may desire a large display area, encompassing perhaps a dozen display panels joined in both the vertical and the horizontal directions. An exhibit at a trade show, for example, may use the display system as a backdrop for a large floor supported piece of equipment, or may require the attachment of shelves or canopies for the display of large or small items. Such an exhibit may also require the use of the display system as a tabletop display backdrop, alone or in conjunction with a larger display.

While being capable of use in a variety of exhibits, the display panels must also be designed for quick and easy disassembly and storage and easy transportation to another location for expeditious reassembly into another exhibit. The needs of the user require that the setting up and dismantling of the system be accomplished with a minimum amount of manual effort, without being required to adhere to complicated and protracted procedures, or utilizing special tools. The system should also be lightweight and collapse into a compact unit which can be manually carried.

As a result of the diversity of uses, there is a need for the display panels of the system to assume various angular positions.

Various prior art display systems which have attempted to meet these various needs have utilized a variety of hinge configurations of complex, costly and fragile design. Furthermore, such prior art systems frequently utilize an exposed border strip for hinge attachment which detracts from the visual esthetic appearance of the presentation.

SUMMARY OF THE INVENTION

Thus, it is an object of invention to provide an improved display panel and hinge system which meets the aforenoted needs.

It is a further object to provide an improved display panel and hinge system that avoids the disadvantages and complexities besetting prior art systems.

It is another object to provide an improved display panel and hinge system which allows easy addition and removal of panels when desired.

It is another object to provide an improved display panel and hinge system which is easily assembled and disassembled and can be easily folded into a compact unit for storage and transport.

It is a further object of this invention to provide a system wherein the hinges thereof allow adjacent panels of the system 360° relative rotation.

Other objects, advantages and features of the present invention will become apparent upon reading the following detailed description and appended claims, and upon reference to the accompanying drawings.

In accordance with one embodiment of this invention, a display system which achieves the foregoing objects includes a plurality of hinges, each of which permits 360° relative rotational movement between adjacent panels, the latter being arranged in side by side relation. Each hinge comprises first and second hinge segments secured to adjacent first and second display panels. Each hinge segment includes upper, middle and lower portions that are arranged in vertically spaced relation. The segments are interconnected by a pair of link pieces. One link piece is pivotally connected to the upper and middle portions of the segments and the second link piece is pivotally connected to the middle and lower portions of the segments. When one segment pivots 180° relative to the other segment, one pivot axis is utilized and when the one segment pivots through a second arc of 180°, a second pivot axis is utilized. The two pivot axes are paralleled to one another and are defined in part by the opposite vertical sides of the link pieces. Each display panel includes a frame in which is disposed a core section. The frame and core section are sandwiched between a pair of outer sections and are concealed thereby. Corresponding sides of the frames of adjacent panels are connected to the hinge segments. When the adjacent panels are disposed in a substantially coplanar relation the hinges are substantially concealed.

BRIEF DESCRIPTION OF THE DRAWINGS

For a more complete understanding of this invention, reference is made to the accompanying drawings wherein:

FIG. 1 is a perspective view of the present invention illustrating the system in a set up condition and with portions of certain display panels removed so as to expose the panel interior;

FIG. 2 is a perspective view of the display system of FIG. 1, in a partially set up condition and showing various finger protrusions disposed between adjoining panels and adapted to accommodate corresponding portions of additional display panels, shown in phantom lines, when the latter are arranged in vertically stacked relation;

FIG. 3 is an enlarged fragmentary perspective view of a corner of one of the display panels, shown in FIG. 1;

FIG. 4 is an enlarged fragmentary sectional view taken along 4—4 of the corner of FIG. 2;

FIG. 5 is an enlarged front elevational view of one embodiment the improved hinge, incorporated in the system of FIG. 1;

FIGS. 6–11 are fragmentary sectional views taken, respectively, along lines 6—6, 7—7, 8—8, 9—9, 10—10, and 11—11 of FIG. 5;

FIG. 12 an enlarged fragmentary sectional view of the hinge taken along line 12—12 of FIG. 16 and showing components thereof in phantom lines in various angular positions;

FIG. 13 is an enlarged rear view of the hinge of FIG. 5;

FIG. 13A is an enlarged fragmentary rear view similar to FIG. 13 but showing modified hinge segments wherein one end of each rib thereof extends endwise beyond the corresponding lower portion of each hinge segment;

FIG. 14 is an enlarged right side elevational view of the hinge of FIG. 13;

FIGS. 15–17 are perspective views of one of the system hinges per se showing the hinge segments thereof in various relative positions as one hinge segment is rotated relative to the other segment through an arc of substantially 360°;

FIG. 18 is a front elevational view of the hinge of FIG. 5 with the components thereof in an exploded relation.

DESCRIPTION

Turning now to FIG. 1 one embodiment of the improved display panel and hinge system 2 is shown which includes a plurality of hingely connected panel assemblies 4. Each panel assembly 4, as shown in FIG. 2, includes an upright first display panel 30 and a second display panel 32. Adjoining panel assemblies 4 may be joined horizontally (FIG. 1) or stacked vertically, see FIG. 2.

As illustrated in FIG. 1, several panel assemblies may be arranged in side by side relation and adjacent edges thereof interconnected so as to enable the system to be readily assembled and disassembled as will be described more fully hereinafter.

Each display panel 30 or 32 is preferably of like construction and incorporates a frame 6, segments of which are formed of metallic or plastic material. Disposed within the frame is an inner or core section **8*a* formed of a lightweight rigid material (e.g. corrugated fibreboard formed in a honeycomb configuration). The frame 6 and accommodated core section 8*a* are sandwiched between and substantially concealed by a pair of outer sections 8*b* on which graphics or the like may be imprinted. The periphery of each outer section 8*b*** is affixed by adhesive or the like to corresponding frame segments and substantially conceals the same thereby forming a borderless display panel. The borderless display panels enhance the visual effect of the display system thereby resulting in a more attractive and esthetic exhibit.

Representative of one of the hinges 10 which effects interconnection of adjoining display panels is shown in FIGS. 5 and 13–18 and includes a first hinge segment 12 and a second hinge segment 14. Each hinge segment 12, 14 is provided with an upper portion U; a middle portion M and a lower portion L, see FIG. 18. The upper, middle and lower portion of each hinge segment are maintained in vertically spaced alignment by an elongated rib or strut 28, 29 affixed to a corresponding face of each portion. The ribs 28, 29 are shown more clearly in FIGS. 13 and 14.

The hinge segments of the hinge 10 are secured to corresponding sides of adjacent display panels. For example, upper portion U of hinge segment 14 is secured to an adjacent vertical side of panel 30 and the lower portion L is secured to the same vertical side of panel 30. The upper and lower portions of the other hinge segment 12 are secured in a similar manner to the vertical side of panel 32. Each upper and lower portion of the hinge segment is attached to the adjacent panel side by threaded fasteners 16, the shanks of which extend through suitable openings 18 formed in each hinge segment, see FIG. 4. When adjacent panels 30, 32 are to be interconnected the ribs 28, 29 initially slidably engage slots 34 formed in the corners of the frame 6 of the adjacent display panels. Once placed in the desired location within the slot, the rib 28, 29 is held in position by the fasteners 16.

In some instances, the ribs 28, 29 of the hinge segments 12 and 14 may extend endwise a short distance beyond the upper or lower portions U, L and form a finger protrusion 39, see FIG. 13A. The finger protrusions 39 are slidably accommodated within slots 34 located at either the top or bottom corner of the frames 6 when the panels are arranged in vertically stacked relation. The coaction of the protrusions 39 and the slots 34 greatly facilitate vertical stacking of the display panels to form a stable exposed front display surface of substantial height.

Where the vertical sides of the end display panels are exposed, a location pin 40 is mounted on one of the abutting corners of the stacked panels. A portion of the location pin protrudes from the one corner and is accommodated within a corresponding slot found in the other abutting corner. Thus, the location pin maintains the end display panels in coplanar relation.

To facilitate understanding of each hinge 10 reference is made to FIG. 18 which shows in exploded relation the components which comprise each hinge. Hinge segments 12 and 14 are of like configuration and each comprises the aforementioned upper, middle and lower portion U, M, & L which are retained in fixed, longitudinally spaced relation by the vertically disposed rib 28, 29.

An upper space I formed between portions U and M of each hinge segment is adapted to accommodate a first link piece 50. In a similar manner, a lower space II formed between portions M and L is adapted to accommodate a second link piece 52. In the illustrated embodiment, the link pieces 50, 52 are of like rectangular configuration. The opposite vertical edges of each link piece are provided with elongated sockets, 50*a*, 50*b* and 52*a*, 52*b*.

Each middle portion M has stepped vertical sides with the step $S_1$, on the left side of the middle portion, as viewed in FIG. 18, being offset upwardly relative to the step $S_2$ formed on the right side of the middle portion. The outer vertical edge of each step is provided with an elongated socket 53, 54.

Each upper portion U, as illustrated, has a rectangular configuration and is offset a small amount to the left of the center line of the corresponding rib 28, 29. The left vertical edge of the upper portion is provided with an elongated socket 55. Sockets 53 and 55 are in vertical alignment with one another.

The lower portion L of each hinge segment 12, 14, as illustrated, has a rectangular configuration and is offset a small amount to the right of the center line of the corresponding rib 28, 29. The right vertical edge of the lower portion is provided with an elongated socket 56 which is in vertical alignment with socket 54 of step $S_2$ of the middle portion M.

When the link pieces 50, 52 are assembled within spaces I and II, respectively, the socket 50*a* of piece 50 is in vertical alignment with the sockets 53 and 55 of the middle and upper portions of the left hinge segment 14, see FIG. 18. The aligned sockets accommodate a first hinge pin $P_1$. The opposite socket 50*b* of link piece 50 is simultaneously vertically aligned with sockets 53 and 55 of the middle and upper portions of the right hinge segment 12 and accommodate a second hinge pin $P_2$. The hinge pins $P_1$ and $P_2$ are in parallel, spaced relation.

Link piece 52 which is accommodated in the space II of hinge segment 12, has the left socket 52*a* thereof in vertical alignment with sockets 54, 56 of the middle and lower portions of hinge segment 14 and the aligned sockets accommodate a third hinge pin $P_3$. Simultaneously therewith the right vertical socket 52*b* of link piece 52 is aligned with sockets 54, 56 of the middle and lower portions M, L of hinge segment 12 and accommodate a fourth hinge pin $P_4$. It should be noted that when hinge segments 12, 14 are in parallel, face to face relation, as seen in FIG. 16, hinge pins $P_1$ and $P_4$ are in axial alignment with one another and define a first hinge or pivot axis; and hinge pins $P_2$ and $P_3$ are in axial alignment and define a second hinge or pivot axis. While pins $P_1$ and $P_4$ and $P_2$ and $P_3$ are in axial alignment, the adjacent ends thereof are in endwise spaced relation forming a small gap G therebetween, see FIG. 16.

Thus, the gap G prevents the aligned pins from interfering with one another, when hinge segment 12 is pivoted relative to hinge segment 14 in the direction of arrow A, as seen in FIG. 15. Hinge segment 12 initially pivots about the first hinge axis defined by the aligned hinge pins $P_2$, $P_3$. When pivoting in direction A, panel 30 which is connected to hinge segment 12 will move through an arc of approximately 180°. When the hinge segments are in parallel, face to face relation, as seen in FIG. 16, the display panels 30 and 32 connected thereto are disposed in side by side substantially coplanar relation.

When hinge segment 12 pivots in the direction of arrow A′ relative to hinge segment 14 from the relative position shown in FIG. 16 to the relative position shown in FIG. 17, the hinge axis is that defined by the aligned hinge pins $P_1$, $P_4$. When pivoting from the position of FIG. 16 to the position of FIG. 17, the panel 30 connected to hinge segment 12 will traverse a further arc of 180° whereupon panel 30 will once again assume a parallel face to face relation with panel 32 but on the opposite side of the latter.

While the display panels are shown to be of like configuration, the invention is not intended to be limited thereto; but, the panels may be of various configurations provided that the sides of the frames to which the hinge segments are connected are planar and disposed in parallel spaced relation when the adjacent panels are in coplanar relation. Furthermore, the number of hinges required beyond two to interconnect adjacent panels will depend upon the height of the panels being interconnected.

Thus, an improved display panel and hinge system has been disclosed which is portable, easily and expeditiously assembled and disassembled, is extremely versatile, is attractive in appearance, and provides large unobstructed display areas.

I claim:

1. In a display panel and hinge system, a hinge for interconnecting a pair of display panels whereby one of the panels is selectively rotatable relative to the other panel through a maximum arc of substantially 360°; said hinge comprising first and second hinge segments mountable on corresponding peripheral sections of the display panels, said hinge segments being interconnected by first and second link pieces each having opposed vertical sides; each hinge segment including upper, middle and lower portions arranged in vertically spaced substantially aligned relation, each portion having opposed first and second vertical sides, each hinge segment having vertically aligned sections of the first vertical sides of said upper and middle portions and vertically aligned sections of the second vertical sides of said middle and lower portions, and vertically extending rib means fixedly mounted on a corresponding surface of each portion intermediate the vertical sides thereof and maintaining said portions in said vertically spaced relation; said first link piece being horizontally aligned with corresponding upper spaces formed between the upper and middle portions of said hinge segments, said second link piece being horizontally aligned with corresponding lower spaces formed between the middle and lower portions of said hinge segments; first means hingedly interconnecting one vertical side of the first link piece with the vertically aligned sections of the first vertical sides of the upper and middle portions of said first hinge segment; second means hingedly interconnecting the other vertical side of the first link piece with the vertically aligned sections of the first vertical sides of the upper and middle portions of said second hinge segment; third means hingedly interconnecting one vertical side of said second link piece with the vertically aligned sections of the second vertical sides of the middle and lower portions of said first hinge segment; and fourth means hingedly interconnecting the other vertical side of said second link piece with the vertically aligned sections of the second vertical sides of the middle and lower portions of said second hinge segment, all of said means being independent of one another; said second and third means coacting to define a common first primary hinge axis about which the display panels are selectively rotated through a first predetermined arc, and said first and fourth means coacting to define a common second primary hinge axis about which the display panels are selectively rotated through a second predetermined arc, the sum of said first and second arcs not exceeding 360° C.

2. The hinge of claim 1 wherein the vertical sides of said link pieces and the first vertical sides of the upper and middle portions and the second vertical sides of the middle and lower portions are provided with vertically extending sockets; and the first, second, third, and fourth means comprise elongated hinge pins accommodated within corresponding sockets.

3. The hinge of claim 1 wherein the upper, middle, and lower portions have a substantially planar configuration.

4. The hinge of claim 2 wherein the first and second vertical sides of the middle portion of each hinge segment have a stepped configuration forming outwardly extending projections, the projection on each first vertical side being adjacent the upper portion and the projection on each second vertical side being adjacent the lower portion, each of said projections being provided with a socket.

5. A display panel and hinge system comprising a plurality of display panels arranged in side-by-side relation; and a plurality of hinges interconnecting adjoining panels; each display panel including a frame, and front and rear sections sandwiching and substantially concealing therebetween said frame; each of said hinges including elongated first and second hinge segments, the first hinge segment being mounted on a vertical first peripheral part of the frame of a first one of the adjoining panels and the second hinge segment being mounted on a corresponding vertical first peripheral part of the frame of a second of the adjoining panels; each hinge segment of each hinge being of unitary construction and having corresponding first and second vertical sides, each vertical side having sections thereof in fixed vertically spaced relation, corresponding vertical sides of the first and second hinge segments being interconnected by at least a pair of longitudinally spaced link means, each of said link means having opposed vertical sides, each hinge segment being provided with a middle portion located between and separating the link means, vertical edges of said middle portion forming a portion of said sections of the first and second vertical sides of said hinge segment and being hingedly connected to corresponding vertical sides of the link means whereby, when said first and second panels are disposed in a substantially parallel face-to-face relation, one of said first and second adjoining panels is selectively rotated relative to the other of said first and second adjoining panels through a maximum arc of substantially 360°; by rotating about a pair of substantially parallel primary vertical hinge axes defined by the vertical sides of said link means.

6. The system of claim 5 wherein each hinge segment is provided with a vertically extending fixedly mounted rib for slidably engaging a slot formed in the vertical peripheral part of the frame of an adjoining panel and being affixed therein at a predetermined location.

7. The system of claim 6 wherein one end of at least one rib projects endwise a predetermined distance beyond a transversely disposed second peripheral part of the frame of said one of said first and second panels and is adapted to lockingly engage a vertically aligned slot formed in the frame of an additional panel when said additional panel and the one adjoining panel are arranged in a vertically stacked relation.

8. The system of claim 5 wherein each hinge segment includes vertically spaced upper and lower portions located above and below said middle portion, respectively, each of said upper and lower portions having opposed vertical sides; said link means including a first link piece having its opposed vertical sides hingedly connected to corresponding vertical sides of the upper and middle portions of said hinge segments and forming first and third vertical hinge axes which together comprises one of the pair of said substantially parallel primary vertical hinge axes, and a second link piece having its opposed vertical sides hingedly connected to corresponding vertical sides of the middle and lower portions of said hinge segments and forming second and fourth vertical hinge axes which together comprises the other of said substantially parallel primary vertical hinge axes.

* * * * *

UNITED STATES PATENT AND TRADEMARK OFFICE

CERTIFICATE OF CORRECTION

PATENT NO. : 4,823,858

DATED : April 25, 1989

INVENTOR(S) : Simon G. A. Perutz

It is certified that error appears in the above-identified patent and that said Letters Patent is hereby corrected as shown below:

Col. 7, line 2, delete "C"
Col. 7, line 41, after "separating" insert --each of--
Col. 8, line 8, delete ";"
Col. 8, line 14, after "rib" delete "for"
Col. 8, line 21, after "second" insert --adjoining--.

Signed and Sealed this

Seventeenth Day of October, 1989

*Attest:*

DONALD J. QUIGG

*Attesting Officer*

*Commissioner of Patents and Trademarks*